US007761998B2

(12) United States Patent
Blaustein et al.

(10) Patent No.: US 7,761,998 B2
(45) Date of Patent: Jul. 27, 2010

(54) WET RAZOR AND ELECTRIC TRIMMER ASSEMBLY

(75) Inventors: Lawrence A. Blaustein, Moreland Hills, OH (US); Douglas A. Gall, Strongsville, OH (US); John William Nottingham, Bratenahl, OH (US); John Osher, Moreland Hills, OH (US)

(73) Assignee: Ridgewood Industries LLC, Bedford Heights, OH (US)

( * ) Notice: Subject to any disclaimer, the term of this patent is extended or adjusted under 35 U.S.C. 154(b) by 0 days.

(21) Appl. No.: 12/400,354

(22) Filed: Mar. 9, 2009

(65) Prior Publication Data

US 2009/0165304 A1 Jul. 2, 2009

(51) Int. Cl.
*B26B 19/02* (2006.01)

(52) U.S. Cl. ..... 30/34.05; 30/216; D28/53

(58) Field of Classification Search ..... 30/34.05, 30/34.1, 43.91, 43.92, 43.9, 44, 45, 216
See application file for complete search history.

(56) References Cited

U.S. PATENT DOCUMENTS

| | | | |
|---|---|---|---|
| 237,138 | A | 2/1881 | Slayton |
| 860,849 | A | 7/1907 | Bradshaw |
| 874,932 | A | 12/1907 | Brigham |
| 1,288,522 | A | 12/1918 | Cowan |
| 1,419,187 | A | 6/1922 | Wilson |
| 1,473,404 | A | 11/1923 | Gaunt |
| 1,765,256 | A | 6/1930 | Barnes |
| 1,822,766 | A | 9/1931 | Duffy |
| 1,825,494 | A | 9/1931 | Warner |
| 1,845,160 | A | 2/1932 | Lewis |
| 1,918,636 | A | 7/1933 | Duffy |
| 2,014,067 | A | 9/1935 | Heimers |
| 2,099,537 | A | 11/1937 | Schmitt |
| 2,127,369 | A | 8/1938 | Ritter |
| 2,149,995 | A | 3/1939 | Gruessner |
| 2,221,314 | A | 11/1940 | Nyhagen |
| 2,243,441 | A | 5/1941 | Russell |
| 2,259,001 | A | 10/1941 | Knapp |
| 2,268,005 | A | 12/1941 | Wright |
| 2,485,787 | A | 10/1949 | Sutch |
| 2,488,436 | A | 11/1949 | Santoro, Sr. |
| 2,588,033 | A | 3/1952 | O'Gatty |
| 2,620,559 | A | 12/1952 | Verdi |
| 2,666,982 | A | 1/1954 | Schroder |
| 2,674,037 | A | 4/1954 | Swenson |
| 2,704,886 | A | 3/1955 | Finelli |

(Continued)

FOREIGN PATENT DOCUMENTS

| | | | |
|---|---|---|---|
| DE | 3444735 | A1 | 6/1985 |

(Continued)

OTHER PUBLICATIONS

Shanghai Zhenbo Electric Co., Ear Hair Trimmer, Internet Website www.zhenbo.en.alibaba.com, Aug. 31, 2004.

*Primary Examiner*—Hwei-Siu C Payer
(74) *Attorney, Agent, or Firm*—Fay Sharpe LLP

(57) ABSTRACT

A razor and trimmer combination assembly includes an elongated handle, a razor blade, a trimmer and a motor. The razor blade is disposed at or adjacent a first end of the handle. The trimmer mounts on the handle and includes a moving blade. The motor drives the moving blade.

10 Claims, 15 Drawing Sheets

U.S. PATENT DOCUMENTS

| | | | |
|---|---|---|---|
| 2,720,695 | A | 10/1955 | Sabiers |
| 2,725,886 | A | 12/1955 | Gagliano |
| 2,764,811 | A | 10/1956 | Guardlno |
| 2,783,533 | A | 3/1957 | Wilson |
| 2,827,695 | A | 3/1958 | Vitale |
| 2,861,339 | A | 11/1958 | Malecki |
| 3,046,654 | A | 7/1962 | Letchfield et al. |
| 3,287,805 | A | 11/1966 | Du Charme |
| 3,364,569 | A | 1/1968 | Dokos |
| 3,552,007 | A | 1/1971 | Yamada |
| 3,557,449 | A | 1/1971 | Popeil |
| 3,636,627 | A | 1/1972 | Tiffin |
| 3,648,368 | A | 3/1972 | Douglass et al. |
| 3,648,370 | A | 3/1972 | Cercone |
| 3,844,035 | A | 10/1974 | Bauerle |
| 3,919,769 | A | 11/1975 | Horn |
| 3,947,960 | A | 4/1976 | Urbaniak |
| 3,962,785 | A | 6/1976 | Poel |
| 3,979,825 | A | 9/1976 | Baumann |
| 4,011,656 | A | 3/1977 | Liedtke |
| 4,031,617 | A | 6/1977 | Tanaka et al. |
| 4,085,503 | A | 4/1978 | Beck et al. |
| D248,579 | S | 7/1978 | Gotoh et al. |
| 4,167,060 | A | 9/1979 | Sakamoto |
| D254,209 | S | 2/1980 | Steinkamp |
| 4,233,733 | A | 11/1980 | Gallanis et al. |
| 4,285,124 | A | 8/1981 | Diakonov |
| D268,371 | S | 3/1983 | Iwai et al. |
| 4,393,585 | A | 7/1983 | Nagelkerke |
| D276,562 | S | 11/1984 | Mizobata et al. |
| 4,498,236 | A | 2/1985 | McIntyre et al. |
| 4,509,259 | A | 4/1985 | Kakumoto et al. |
| 4,512,077 | A | 4/1985 | Tanabe et al. |
| D279,411 | S | 6/1985 | Abe et al. |
| 4,521,962 | A | 6/1985 | Van Natta |
| D279,509 | S | 7/1985 | Abe et al. |
| 4,542,828 | A | 9/1985 | Gotto |
| D283,061 | S | 3/1986 | Kitashima et al. |
| D283,736 | S | 5/1986 | Wahl et al. |
| 4,614,032 | A | 9/1986 | Szabo |
| D286,210 | S | 10/1986 | Abe et al. |
| D286,328 | S | 10/1986 | Ullmann |
| D286,452 | S | 10/1986 | Ullmann |
| 4,635,361 | A | 1/1987 | DeMars |
| 4,642,892 | A | 2/1987 | Ishida |
| D290,531 | S | 6/1987 | Seiffert et al. |
| D293,265 | S | 12/1987 | Ullman |
| 4,709,475 | A | 12/1987 | Phung |
| D294,407 | S | 2/1988 | Ullmann |
| D295,564 | S | 5/1988 | Iwai |
| D295,682 | S | 5/1988 | Iwai et al. |
| 4,744,144 | A | 5/1988 | Lowery, Sr. et al. |
| D297,375 | S | 8/1988 | Liu |
| 4,760,642 | A | 8/1988 | Kwak |
| 4,837,929 | A | 6/1989 | Tanahashi et al. |
| D302,345 | S | 7/1989 | Rubin |
| D302,601 | S | 8/1989 | Uchida |
| 4,854,042 | A | 8/1989 | Byrne |
| 4,866,843 | A | 9/1989 | Kumano |
| D304,866 | S | 11/1989 | Yonezawa et al. |
| D304,867 | S | 11/1989 | Okamoto |
| D305,074 | S | 12/1989 | Mockovak |
| D305,466 | S | 1/1990 | Satoh |
| 4,903,404 | A | 2/1990 | Labrijn |
| D306,917 | S | 3/1990 | Terasawa et al. |
| 4,914,816 | A | 4/1990 | Fenn et al. |
| 4,980,973 | A | 1/1991 | Lee et al. |
| 4,989,328 | A | 2/1991 | Sokoloff |
| 5,007,169 | A | 4/1991 | Motta |
| 5,022,153 | A | 6/1991 | Baron |
| 5,046,249 | A | 9/1991 | Kawara et al. |
| 5,054,199 | A * | 10/1991 | Ogawa et al. ..... 30/34.1 |
| 5,105,541 | A | 4/1992 | Messinger et al. |
| 5,153,994 | A | 10/1992 | Emmett |
| 5,214,851 | A | 6/1993 | Althaus |
| D337,857 | S | 7/1993 | Nakashima et al. |
| D339,655 | S | 9/1993 | Sulik |
| D340,540 | S | 10/1993 | Nakashima et al. |
| D343,025 | S | 1/1994 | Sulik |
| D343,923 | S | 2/1994 | Nakashima et al. |
| D346,462 | S | 4/1994 | Tanaka et al. |
| D346,463 | S | 4/1994 | Nakashima et al. |
| 5,299,354 | A | 4/1994 | Metcalf et al. |
| 5,325,590 | A | 7/1994 | Andis et al. |
| 5,386,631 | A | 2/1995 | Van Asten et al. |
| 5,386,750 | A | 2/1995 | Morrison |
| D365,890 | S | 1/1996 | Bone |
| 5,542,178 | A | 8/1996 | Harkleroad |
| D377,404 | S | 1/1997 | Izumi |
| D377,847 | S | 2/1997 | Sulik |
| D386,822 | S | 11/1997 | Van Scoyoc et al. |
| 5,701,673 | A | 12/1997 | Ullmann et al. |
| D389,956 | S | 1/1998 | Schulz |
| 5,732,470 | A | 3/1998 | Labarbara |
| 5,745,995 | A | 5/1998 | Yamashita et al. |
| 5,794,342 | A | 8/1998 | Davey |
| D400,303 | S | 10/1998 | Tanaka et al. |
| D403,115 | S | 12/1998 | Tanaka et al. |
| D403,468 | S | 12/1998 | Smith |
| D405,230 | S | 2/1999 | Akashi et al. |
| D405,923 | S | 2/1999 | Yang |
| D405,924 | S | 2/1999 | Lebherz |
| D408,102 | S | 4/1999 | Van Asten |
| D408,586 | S | 4/1999 | Nielsen et al. |
| D413,182 | S | 8/1999 | Smith |
| 5,933,962 | A | 8/1999 | Labarbara |
| D417,931 | S | 12/1999 | Lebherz |
| 6,029,354 | A | 2/2000 | Apprille et al. |
| D421,818 | S | 3/2000 | Mandell et al. |
| D422,752 | S | 4/2000 | Pickett |
| D423,720 | S | 4/2000 | Nielsen et al. |
| 6,044,558 | A | 4/2000 | Wu |
| 6,052,905 | A | 4/2000 | Branchinelli et al. |
| D429,376 | S | 8/2000 | Nagano et al. |
| D429,378 | S | 8/2000 | Wu |
| 6,098,288 | A | 8/2000 | Miyagawa et al. |
| D435,694 | S | 12/2000 | Lebherz |
| 6,226,869 | B1 | 5/2001 | Heintke et al. |
| D446,605 | S | 8/2001 | Speh |
| D447,837 | S | 9/2001 | Kling et al. |
| 6,311,837 | B1 | 11/2001 | Blaustein et al. |
| D454,978 | S | 3/2002 | Hoffman et al. |
| D454,979 | S | 3/2002 | Hoffman et al. |
| D455,862 | S | 4/2002 | Wagenknecht et al. |
| D456,564 | S | 4/2002 | Ullmann |
| D456,947 | S | 5/2002 | Hoffman et al. |
| 6,406,157 | B1 | 6/2002 | Audet |
| 6,421,918 | B1 | 7/2002 | Dato et al. |
| 6,434,839 | B1 | 8/2002 | Lee et al. |
| 6,481,104 | B1 | 11/2002 | Parker et al. |
| 6,490,799 | B2 | 12/2002 | Eich et al. |
| 6,502,312 | B2 | 1/2003 | Beutel et al. |
| D470,272 | S | 2/2003 | Fong |
| 6,526,660 | B1 | 3/2003 | MacNeil |
| 6,560,876 | B2 | 5/2003 | Carr |
| D479,360 | S | 9/2003 | Nishizawa et al. |
| D479,363 | S | 9/2003 | Micinilio |
| D481,491 | S | 10/2003 | Nishizawa et al. |
| D486,606 | S | 2/2004 | Goetschi |
| 6,684,507 | B2 | 2/2004 | Lau et al. |
| 6,928,738 | B2 | 8/2005 | Segrea |
| 7,028,405 | B2 * | 4/2006 | Paas et al. ..... 30/45 |
| 7,350,300 | B2 * | 4/2008 | Yamaguchi et al. ..... 30/43.92 |
| D568,539 | S | 5/2008 | Micinilio et al. |

| | | | | |
|---|---|---|---|---|
| D571,954 | S | 6/2008 | Kling et al. | |
| 7,536,787 | B2 * | 5/2009 | Blaustein et al. | 30/34.05 |
| 2001/0017255 | A1 | 8/2001 | Katsumi | |
| 2002/0026721 | A1 | 3/2002 | Lee et al. | |
| 2002/0038772 | A1 | 4/2002 | Blaustein et al. | |
| 2002/0157262 | A1 | 10/2002 | Talavera | |
| 2003/0134255 | A1 | 7/2003 | Masterman et al. | |
| 2003/0167639 | A1 | 9/2003 | Sassenberg | |
| 2004/0045168 | A1 | 3/2004 | Talavera | |
| 2004/0158990 | A1 | 8/2004 | Heide | |
| 2007/0006463 | A1 | 1/2007 | Pennella | |
| 2008/0016691 | A1 * | 1/2008 | Pennella et al. | 30/34.1 |
| 2009/0000125 | A1 * | 1/2009 | Peyser et al. | 30/34.1 |
| 2009/0056137 | A1 * | 3/2009 | Royle | 30/34.1 |
| 2009/0165303 | A1 * | 7/2009 | Burgess et al. | 30/29.5 |
| 2010/0037463 | A1 * | 2/2010 | Maichel et al. | 30/34.1 |

FOREIGN PATENT DOCUMENTS

| | | | |
|---|---|---|---|
| DE | 3428631 | A1 | 2/1986 |
| DE | 4026142 | A1 | 2/1991 |
| EP | 0 499 840 | A2 | 8/1992 |
| EP | 0 997 241 | A1 | 5/2000 |
| EP | 1 174 227 | A2 | 1/2002 |
| EP | 0 707 926 | B1 | 6/2002 |
| EP | 1 375 089 | A1 | 1/2004 |
| EP | 1 410 884 | A | 4/2004 |
| FR | 1012215 | | 7/1952 |
| GB | 862726 | | 3/1961 |
| GB | 1065510 | | 4/1967 |
| GB | 2 198 382 | A | 6/1988 |
| JP | 47-9691 | | 10/1972 |
| JP | 47-31356 | | 12/1972 |
| JP | 48-66791 | | 8/1973 |
| JP | 50-30994 | | 4/1975 |
| JP | 53-148893 | | 11/1978 |
| JP | 54-16690 | | 2/1979 |
| JP | 55-60488 | | 5/1980 |
| JP | 55-130669 | | 9/1980 |
| JP | 56-91787 | | 7/1981 |
| JP | 58-106830 | | 7/1983 |
| JP | 58-178935 | | 11/1983 |
| JP | 59-101974 | | 7/1984 |
| JP | 60-106489 | | 6/1985 |
| JP | 60-103480 | | 7/1985 |
| JP | 60-103481 | | 7/1985 |
| JP | 60-129074 | | 7/1985 |
| JP | 61-14981 | | 1/1986 |
| JP | 61-64878 | | 5/1986 |
| JP | 61-67672 | | 5/1986 |
| JP | 62-146484 | | 9/1987 |
| JP | 63-220898 | | 9/1988 |
| JP | 63-179826 | | 11/1988 |
| JP | 63-186379 | | 11/1988 |
| JP | 02-134184 | | 5/1990 |
| JP | 02-142588 | | 5/1990 |
| JP | 02-161980 | | 6/1990 |
| JP | 02-161981 | | 6/1990 |
| JP | 02-185287 | | 7/1990 |
| JP | 02-195983 | | 8/1990 |
| JP | 02-215492 | | 8/1990 |
| JP | 02-299686 | | 12/1990 |
| JP | 3-20964 | | 2/1991 |
| JP | 03-155893 | | 7/1991 |
| JP | 03-193085 | | 8/1991 |
| JP | 03-193086 | | 8/1991 |
| JP | 3-119370 | | 12/1991 |
| JP | 40-25106 | | 1/1992 |
| JP | 05-309184 | | 11/1993 |
| JP | 6 11675 | | 2/1994 |
| JP | 60-11675 | U | 2/1994 |
| JP | 6-501868 | | 3/1994 |
| JP | 60-267771 | U | 4/1994 |
| JP | 11-009854 | | 1/1999 |
| JP | 11-151387 | | 6/1999 |
| JP | 2000-254367 | | 9/2000 |
| JP | 2000-300869 | | 10/2000 |
| JP | 2001-276449 | | 10/2001 |
| JP | 2001-340669 | | 12/2001 |
| JP | 2002-028383 | | 1/2002 |
| JP | 2003-103074 | | 4/2003 |
| JP | 2003-181165 | | 7/2003 |
| WO | WO 87/00112 | | 1/1987 |
| WO | WO 98/28113 | | 7/1998 |

* cited by examiner

WET RAZOR AND ELECTRIC TRIMMER ASSEMBLY

This application claims the benefit of U.S. pending patent application, Ser. No. 10/885,278, filed Jul. 6, 2004, which claims the benefit of U.S. provisional patent application Ser. No. 60/557,745, "Razor and Electric Trimmer Assembly" filed Mar. 30, 2004, which are incorporated by reference.

BACKGROUND OF THE INVENTION

Wet razors are typically used with shaving cream and water to shave a man's face or a woman's legs. These wet razors typically include an elongated handle having a razor blade and/or a razor blade cartridge attached to one end of the handle. The user pulls the razor blade across the skin cutting the hair that is present.

Electric trimmers are also known for trimming longer hairs such as sideburns, mustaches, beards, as well as the bikini area of a woman. Electric trimmers typically include a stationary blade and a moving blade. Since the trimmers are typically powered by electricity and the wet razor is typically submerged in water, assemblies that employ both a wet razor and a hair trimmer assembly are not known.

SUMMARY OF THE INVENTION

A razor and trimmer combination assembly includes an elongated handle, a razor blade, a trimmer and a motor. The razor blade is disposed at or adjacent a first end of the handle. The trimmer mounts on the handle and includes a moving blade. The motor is disposed within the handle and operatively connected to the moving blade.

A grooming tool includes a housing, a razor mount, a trimmer mechanism, a motor, a linkage, a power source compartment, and a power source connector. The housing includes an elongated handle portion and a head end portion. The razor mount is disposed at the head end portion of the housing and selectively secures an associated razor blade or an associated razor blade cartridge. The trimmer mechanism is associated with the housing. The motor mounts within the housing. The linkage couples an output shaft of the motor to the trimmer mechanism. The power source compartment is disposed within the housing and is adapted to receive an associated power source. The power source connector mounts within the power source compartment and provides at least a portion of a power delivery path between the associated power source installed in the power source compartment and the motor.

A method of manufacturing a wet razor and trimmer combination assembly having a vibrating handle includes the following steps: providing a wet razor and trimmer combination assembly comprising a wet razor mounted at or adjacent a first end of a handle and trimmer disposed on the handle, and providing a drive inside the handle to impart vibratory motion on the first end of the handle.

The combination of a package and an electric grooming tool disposed in the package includes a cover at least partially enclosing the grooming tool. The grooming tool includes a handle, a razor mount disposed at or adjacent one end of the handle, a trimmer disposed on the handle, a drive mechanism for the trimmer, a power source for the drive mechanism, a switch for selectively supplying power from the power source to the drive mechanism, and a switch button disposed on the handle for operating the switch. The cover is adapted to allow an external force to be exerted on the switch button such that the switch button can move into the momentary on position.

DETAILED DESCRIPTION

Figure 1A:
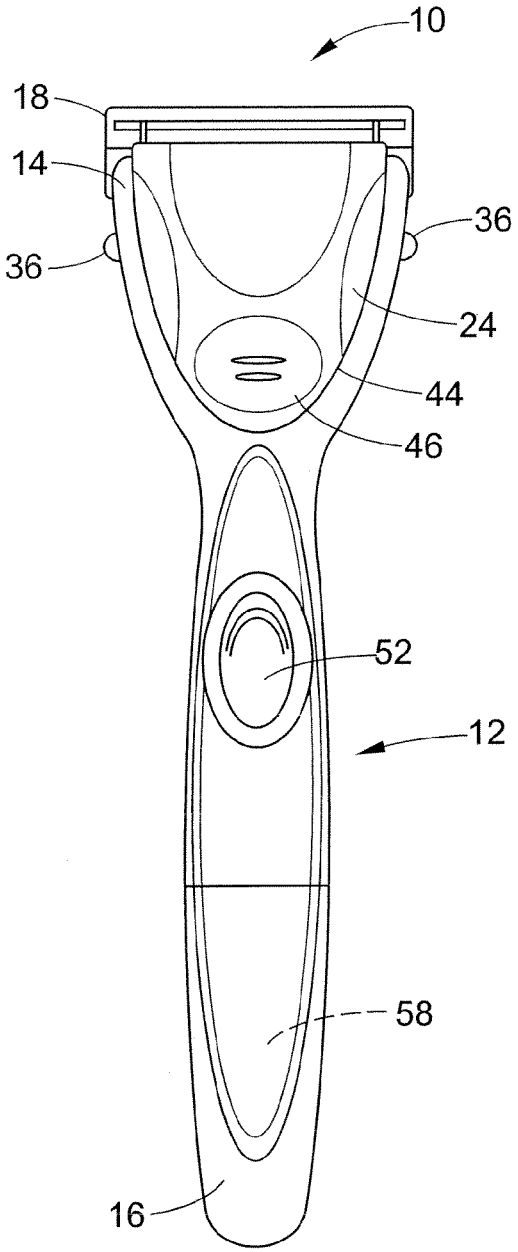
FIGS. 1A-1D are a rear, side and front view of a first embodiment of a razor and trimmer combination assembly.
Figure 1D:
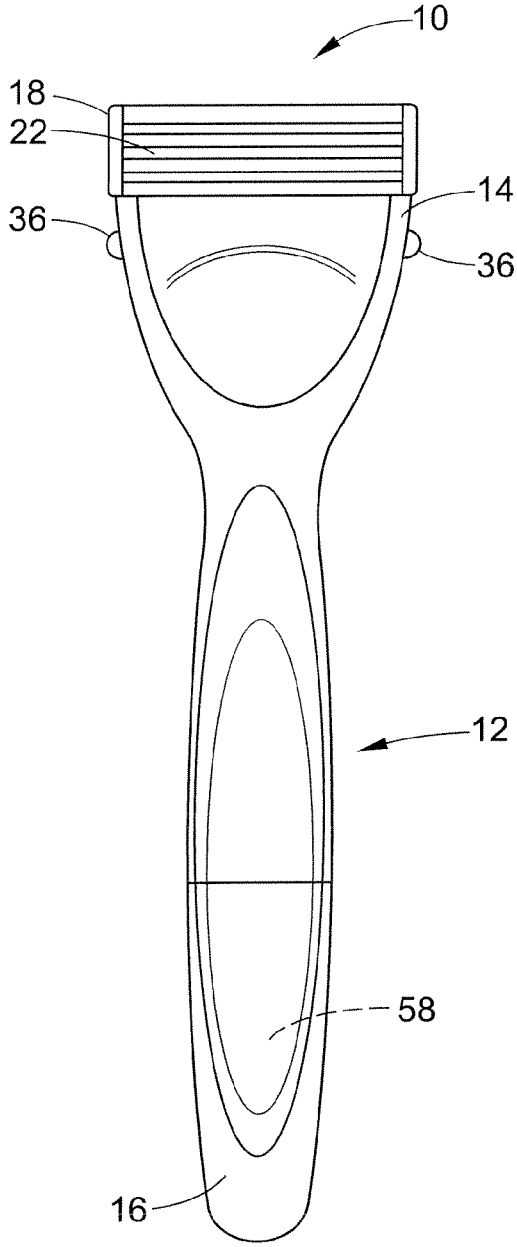
Figure 1B:
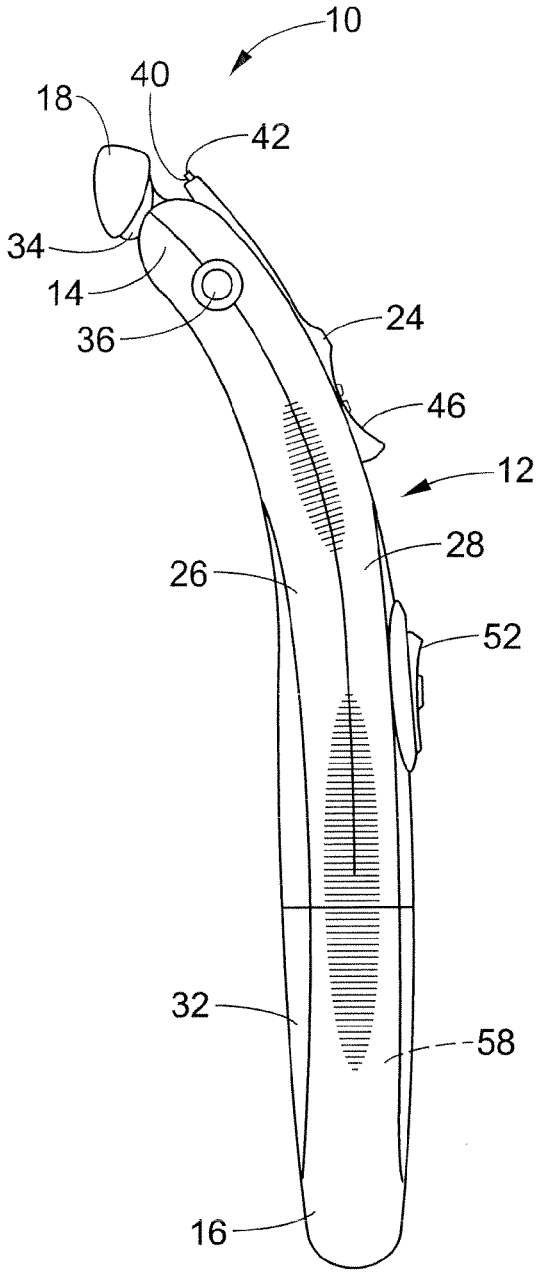

A grooming tool 10, which can also be referred to as a razor and trimmer combination assembly, includes a thin elongated handle 12 having a first or head end 14 and a second or tail end 16. A razor blade cartridge 18, which can include a plurality of razor blades 22 mounted in the cartridge, attaches at or adjacent the first end 14 of the handle 12. The razor blade cartridge 18 generally faces a direction that will be referred to as forward simply for clarity. Accordingly, the razor blade cartridge 18 generally faces the same direction as a front side of the handle 12. A trimmer 24 is also disposed at or adjacent the first end 14 of the handle 12. The trimmer 24 extends from a rear side of the handle 12. One who shaves with the grooming tool 10 can use the razor blades 22 for conventional wet shaving and can use the trimmer 24 for dry trimming.

The thin handle 12 curves toward the direction that the razor blade cartridge 18 faces similar to a conventional wet razor. The handle 12 provides a housing for internal components that drive the trimmer 24. In the embodiment depicted in FIGS. 1A-1D, the handle 12 is formed from three separate pieces. A first piece 26 corresponds to the front side of the handle, a second piece 28 corresponds to the rear side of the handle, and a third piece 32 attaches to the first and second pieces to form the tail end of the handle. In this embodiment, the front piece 26 permanently affixes to the rear piece 28, and the tail piece 32 selectively attaches to the front and rear pieces via a bayonet attachment or other conventional attachment.

As mentioned above, the razor blade cartridge 18 attaches at or adjacent the first end 14 of the handle 12. In the depicted embodiment, a cartridge mount 34 is provided at the first end 14 of the handle 12 to mount the cartridge 18 to the handle 12. The razor blade cartridge 18 selectively attaches to and detaches from the cartridge mount 34. Any known shaving cartridge mount can be utilized. In this embodiment, release buttons 36 cooperate with the razor mount 34 such that when the release buttons are pressed inward, i.e., toward the handle 12, the mount disengages the razor cartridge so that the cartridge can be removed. Similar to a conventional wet razor, the cartridge 18 can pivot in an axis parallel with the length direction of the cartridge, which is generally perpendicular to the handle 12.

Figure 1C:
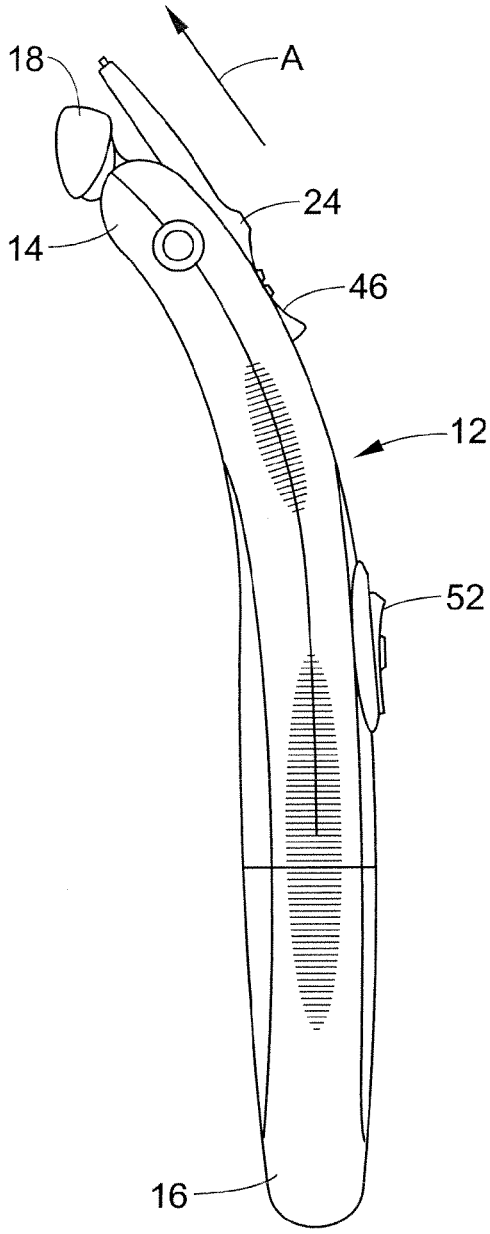

In addition to the razor cartridge 18, the trimmer 24 is also disposed at or adjacent the first end 14 of the handle 12. The trimmer 24 is similar to a conventional trimmer in that the trimmer includes a first or stationary blade 40 and a second or moving blade 42. Alternatively, the trimmer 24 can include two moving blades, or a plurality of moving blades. In the embodiment depicted in FIGS. 1A-1D, the trimmer 24 slides in a recess 44 along and parallel to the rear of the handle 12 near the head end in a direction generally aligned with arrow A (FIG. 1C) between a use position and a stored position. The recess 44 is a complementary shape to the trimmer 24. The trimmer 24 mounts to the housing 12 such that the direction of movement of the moving trimmer blade 42 is generally parallel to the length of the razor blades 22. Accordingly, the user of the grooming tool 10 need not change the way he or she usually grips a razor to use the trimmer 24. As seen in FIG. 1C, in the use position, the trimmer 24 can extend vertically above the cartridge 18, which allows a user of the grooming tool 10 to use the trimmer and the cartridge does not block the view in the mirror of the area being trimmed.

Figure 2C:
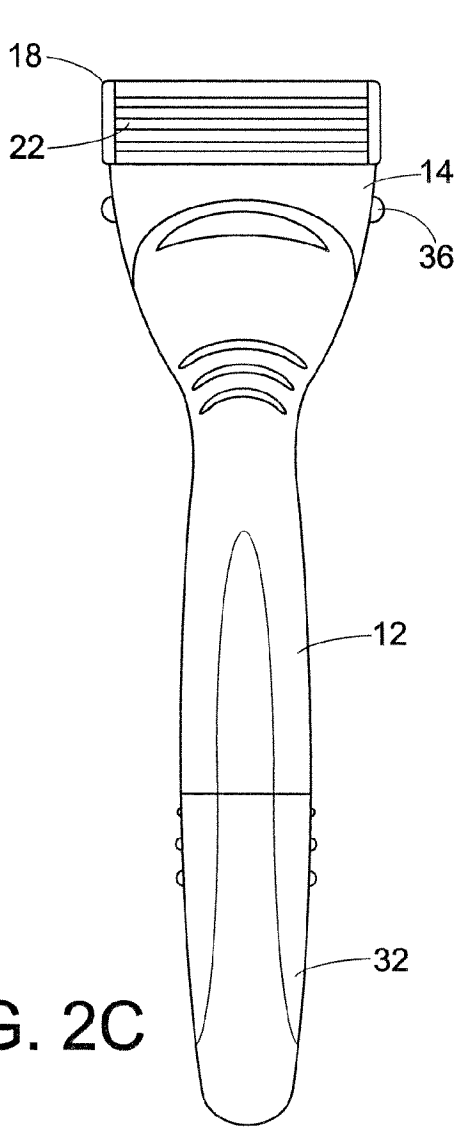
FIGS. 2A-2C are a rear, side and front view of another embodiment of a razor and trimmer combination assembly.
Figure 2B:
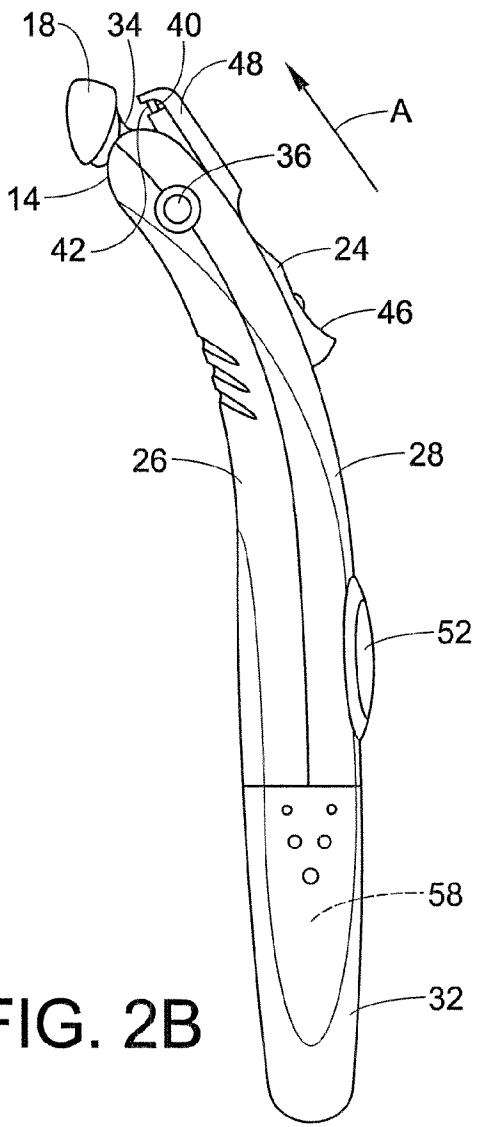
Figure 2A:
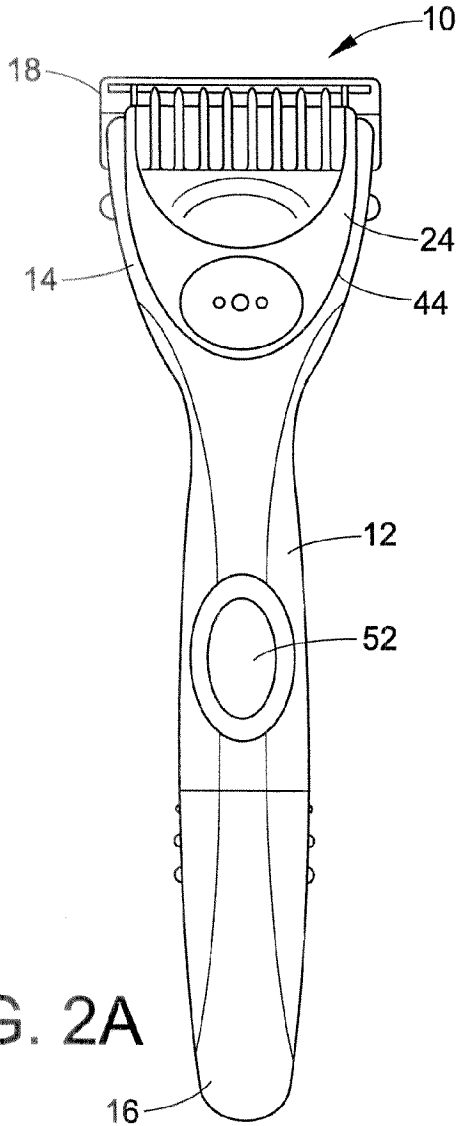

The trimmer 24 is provided with a finger pad 46 where a user can place his finger or thumb to move the trimmer. As seen in the embodiment depicted in FIGS. 2A-2C, a guard 48 can mount to the trimmer 24 spaced from the blades 40 and 42. The guard 48 can also move in a direction parallel to the arrow A to allow for the trimming of hair to different heights.

Figure 3A:
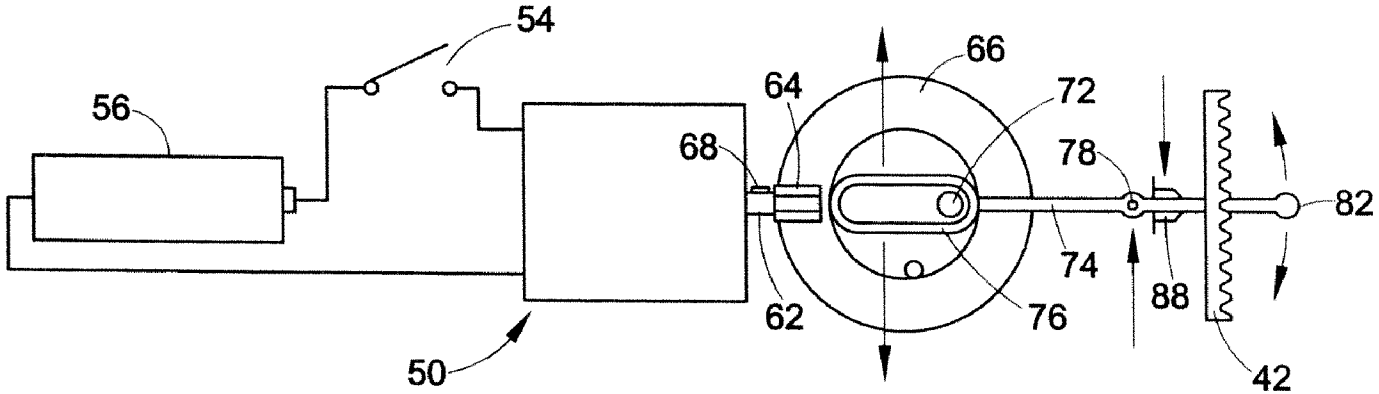
FIGS. 3A and 3B are top and side schematic views of a drive train assembly for the razor and trimmer combination assembly.

Referring to FIG. 3A, a motor 50, through a transmission housed in the handle 12 and that will be described in more detail below, drives the moving blade 42 of the trimmer 24. With reference back to FIGS. 1A and 1B, a switch button 52 activates a switch 54 (FIG. 3A) to selectively open and close a circuit to provide power to the motor 50 from a power source 56. The switch button 52 is positioned on the handle 12 underneath the trimmer 24. Alternatively, the switch button 52 can be located elsewhere.

The handle 12 also defines a power source compartment 58 that is adapted to receive a AAA battery 56 to provide power to the motor 50. Alternatively, the power source compartment 52 can be sized differently so that it can receive a different sized battery and/or power source. The power source 56 is accessible by removing the tail piece 32 from the front piece 26 and rear piece 28 of the handle 12.

Figure 4:
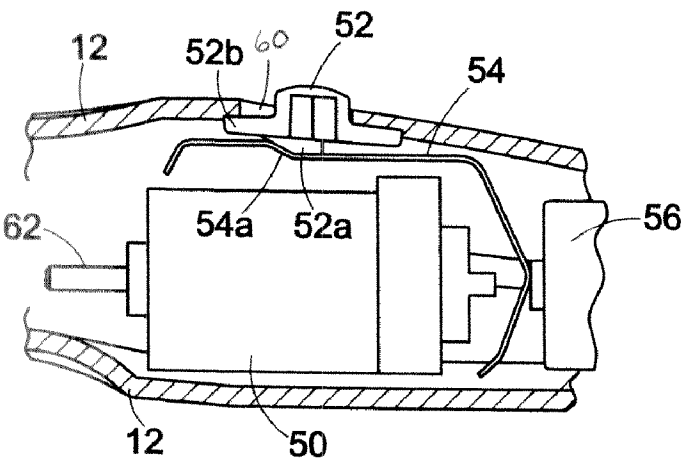
FIG. 4 is a side cross section of a switching mechanism for the razor and trimmer combination assembly.

The switch button 52 can be depressed inward and held in by the user so that the motor is in a momentary on position. The switch button 52 can also be depressed inward and slid in a first direction into a continuously on position where the motor 50 is energized until the switch button is slid in a second direction that is opposite the first direction. One non-limiting example of a switch mechanism is depicted in FIG. 4; the switch button 52 contacts a metal contact, which acts as the schematic switch 54 depicted in FIG. 3A. The switch button is movable in an opening 60 formed in the handle 12. Moving the switch button 52 towards the head end 14 of the handle 12 results in a lowered ramped protuberance 52*a* formed in the switch button 52 to ride over a ramp 54*a* formed in the metal contact 54 closing the circuit between the power source 56 and the motor 50. The metal contact 54 biases a lower forward portion 52*b* of the switch button towards the handle 12 so that the switch button 52 is maintained in a continuously on position. Pressing the switch button 52 towards the motor 50 temporarily closes the circuit while the button is depressed. The metal contact 54 biases the switch button 52 away to open the circuit when no force is applied on the switch button 52 and the switch button is not trapped by the handle 12. In an alternative embodiment, the handle 12 can provide a temporary catch for the switch button 52 to allow the switch button to move into a continuously on position.

Figure 3B:
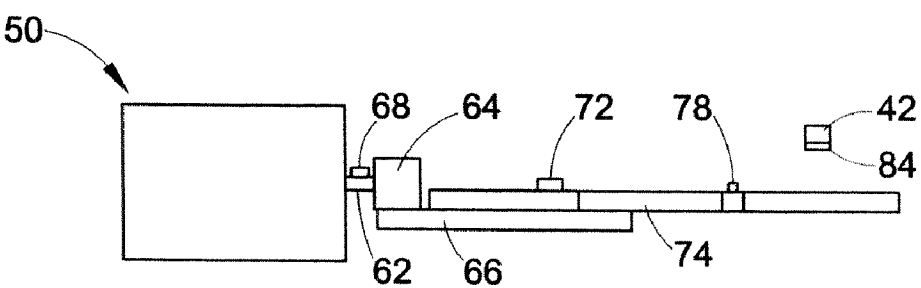

Any transmission or linkage that translates the rotational movement of the motor 50 to reciprocating lateral movement can be used to connect the motor to the moving blade 42. A drive train, which is depicted schematically in FIGS. 3A and 3B, is housed in the handle. In this embodiment, an output shaft 62 extends from the motor 50. A pinion 64 attaches to the output shaft 62 and engages a crown gear 66 disposed underneath the pinion. A weight 68, which can include an off-center weight, can also attach to the output shaft 62.

A post 72 extends normally from the crown gear 66. A follower rod 74 having an elliptical hoop 76 at one end connects to the post 72 by the hoop receiving the post. The follower rod 74 is fixed to the handle 12 (not shown in FIG. 3A) or some other structure by a pivot pin 78 about which the rod can pivot. The moving blade 42 mounts to and slides along the follower rod 74.

When the switch button 52 is depressed into the momentary on position or slid into the continuously on position to close the switch 54, power is delivered from the power source 56 to the motor 50. The motor 50 rotates the pinion 64 which drives the crown gear 66. The crown gear 66 rotates with the post 72 on the hoop end 76 of the follower rod 74. Since the elliptical hoop 76 on the follower rod 74 has a minor axis that is perpendicular to the longitudinal axis of the follower rod and about equal to the diameter of the post 72 and a major axis that is parallel to the longitudinal axis of the follower rod and substantially greater than the diameter of the post, forces perpendicular to the axis of the follower rod, i.e., side-to-side, are translated to the follower rod and forces parallel to the axis of the follower rod are not translated to the follower rod. Accordingly, the follower rod 74 pivots about the pivot pin 78 resulting in lateral reciprocal movement of the moving blade 42.

As mentioned above, the moving blade 42 slides along the follower rod 74 between a distal end 82 of the follower rod and the pivot pin 78. The moving blade 42 is adjacent the pin 78 when in the stored position and is adjacent the distal end 82 when in a use position. To attach to the follower rod 74, the moving blade 42 includes a bracket 84 (FIG. 3B) that depends from the blade and receives the rod. An opening or slot is provided in the handle 12 through which the bracket 84 extends to attach the follower rod 74, which is disposed inside the handle 12, to the moving blade 42, which mounts to the outside of the handle.

As the moving blade 42 is moved farther away from the pivot pin 78, e.g., from the stored position to the use position, the angular displacement of the distal end 82 of follower rod 74 is greater and, therefore, the lateral movement of the moving blade 42 is greater. The lateral reciprocal movement of the moving trimmer blade 42 can result in a desirable vibration of the first end 14 of the handle 12 which results in vibration of the razor cartridge 18. Additionally, the off-center weight 68 on the output shaft 62 of the motor 50 can also result in desirable vibration of the razor handle 12.

Since the razor blades 22 are periodically rinsed with water during use, gaskets are provided to protect the internal components of the assembly. A first gasket 88 receives the follower rod 74 to protect the components of the drive train assembly below the first gasket. As seen in FIG. 3A, the first gasket 88 is positioned next to the pivot pin 78 and cooperates with an internal wall of the handle (not shown). In an alternative embodiment, the pivot pin 78 can be replaced by the first gasket where the gasket is made from a flexible material. A second gasket is provided at the connection of the third piece 32 of the handle 12 to the first and second pieces 26, 28 to protect the battery.

Figure 5C:
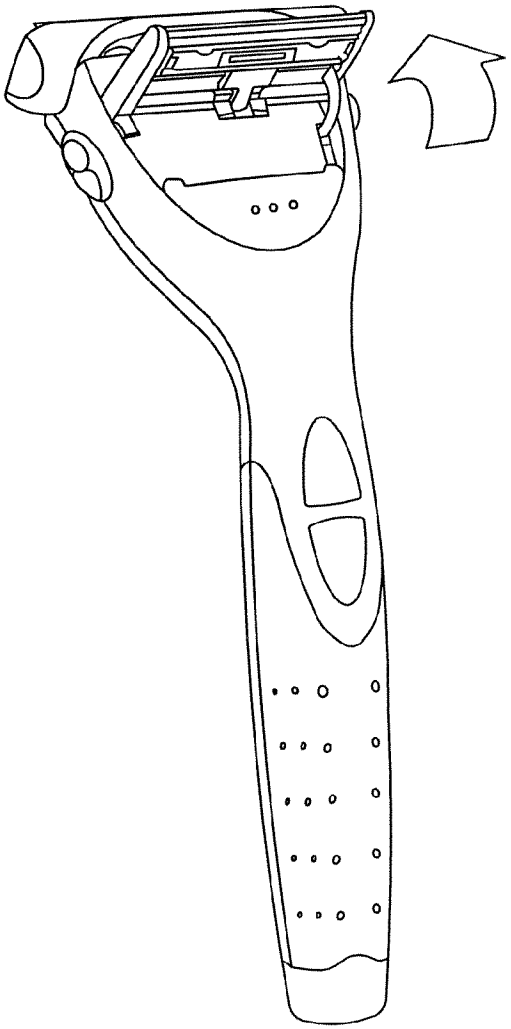
FIGS. 5A-5C are front and rear perspective views of another embodiment of a razor and trimmer combination assembly.
Figure 5B:
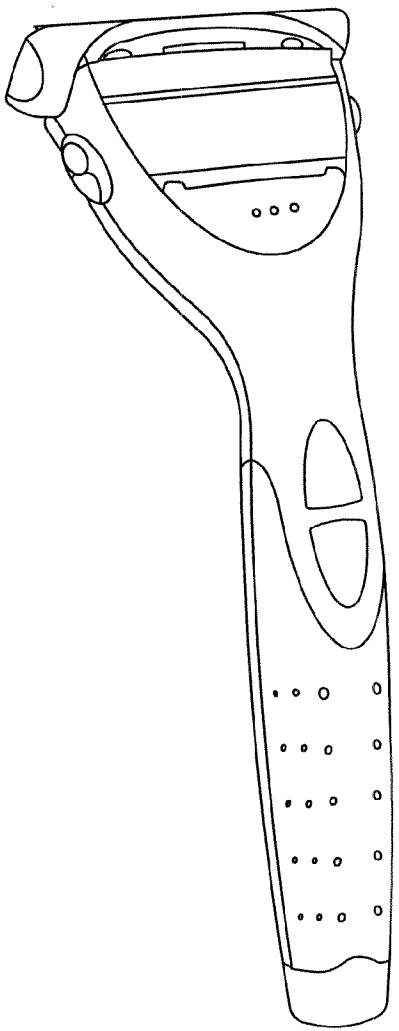
Figure 5A:
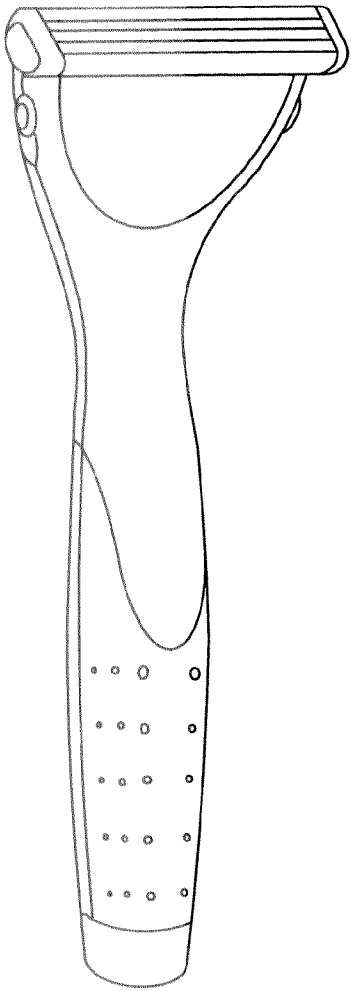
Figure 6C:
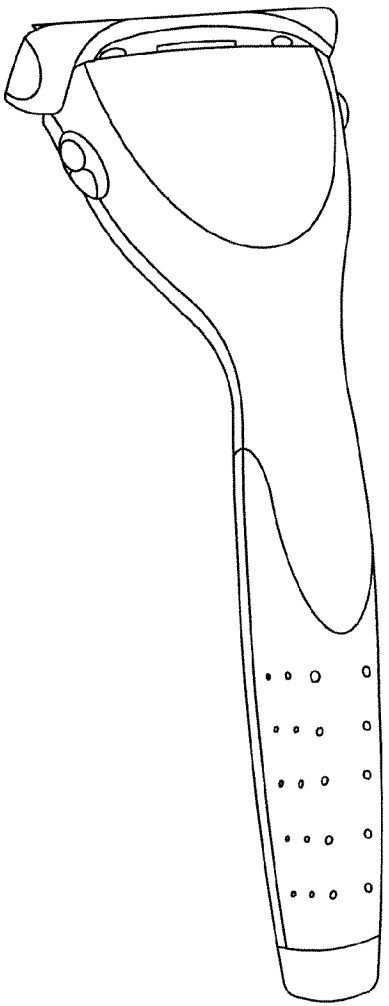
FIGS. 6A-6C are front and rear perspective views of another embodiment of a razor and trimmer combination assembly.
Figure 6B:
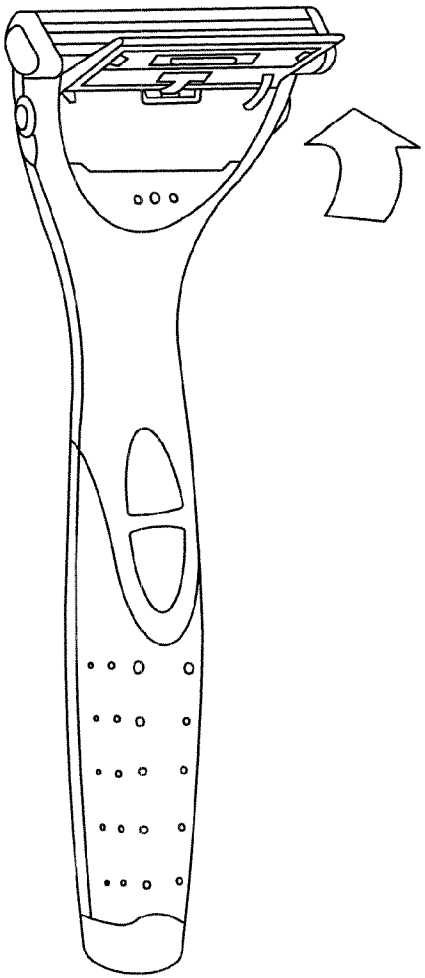
Figure 6A:
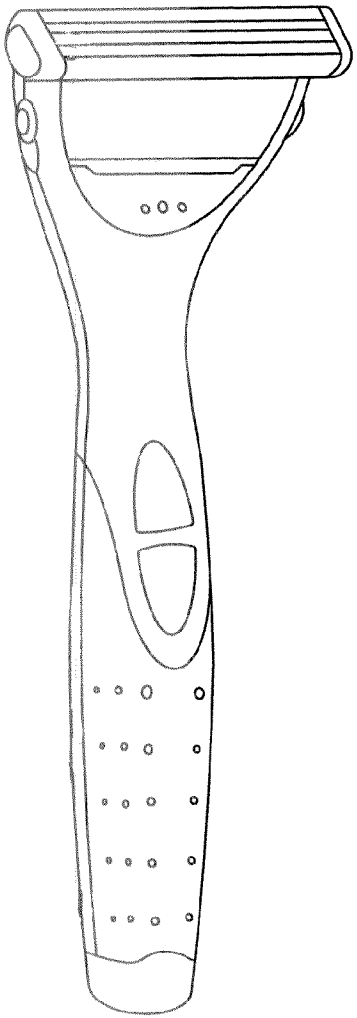
Figure 7A:
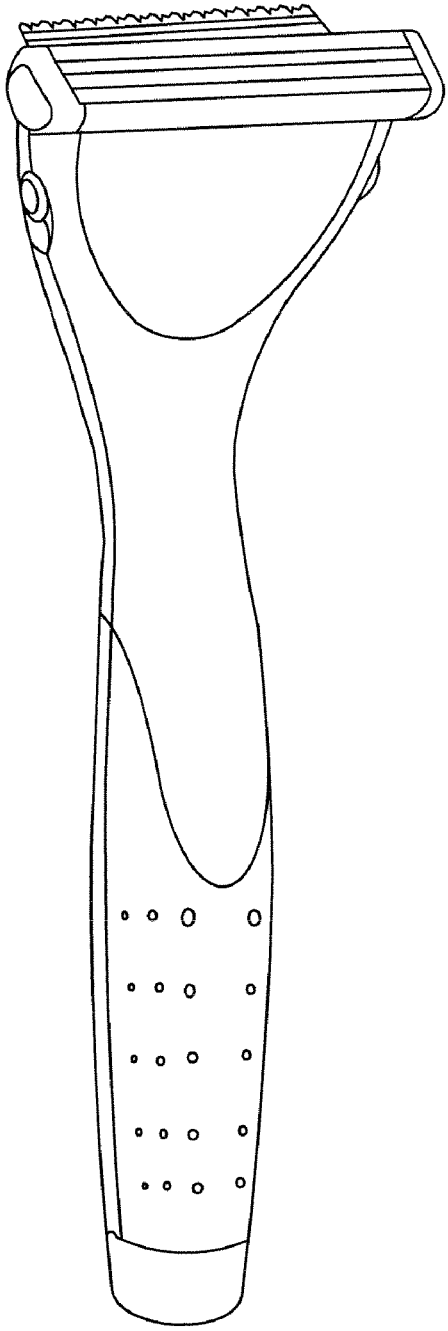
FIGS. 7A and 7B are front and rear perspective views of another embodiment of a razor and trimmer combination assembly.
Figure 7B:
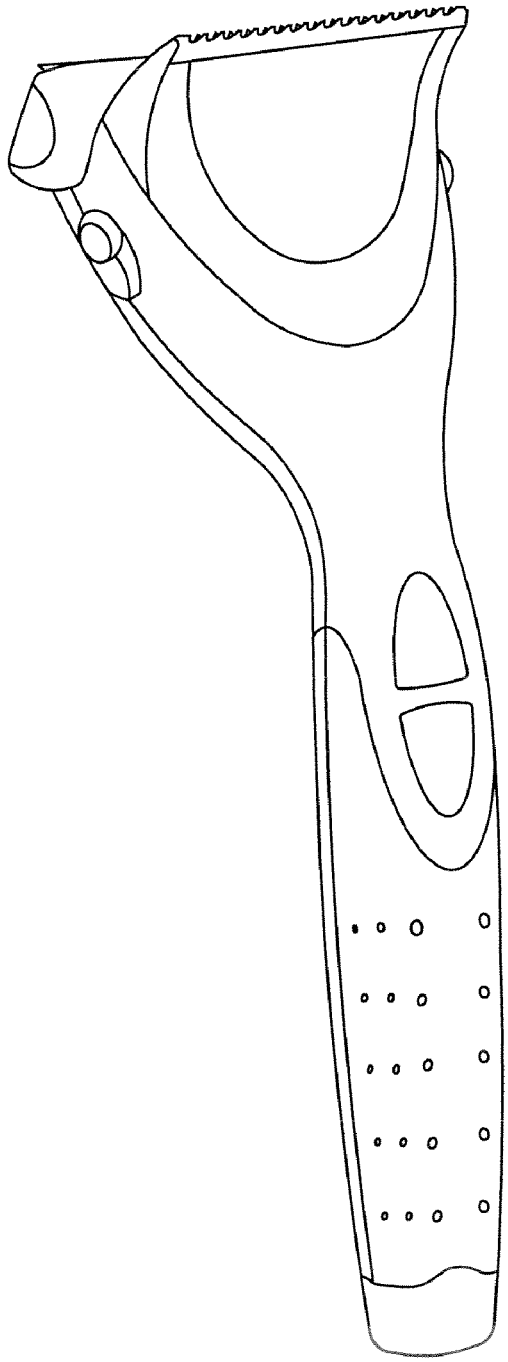
Figure 8A:
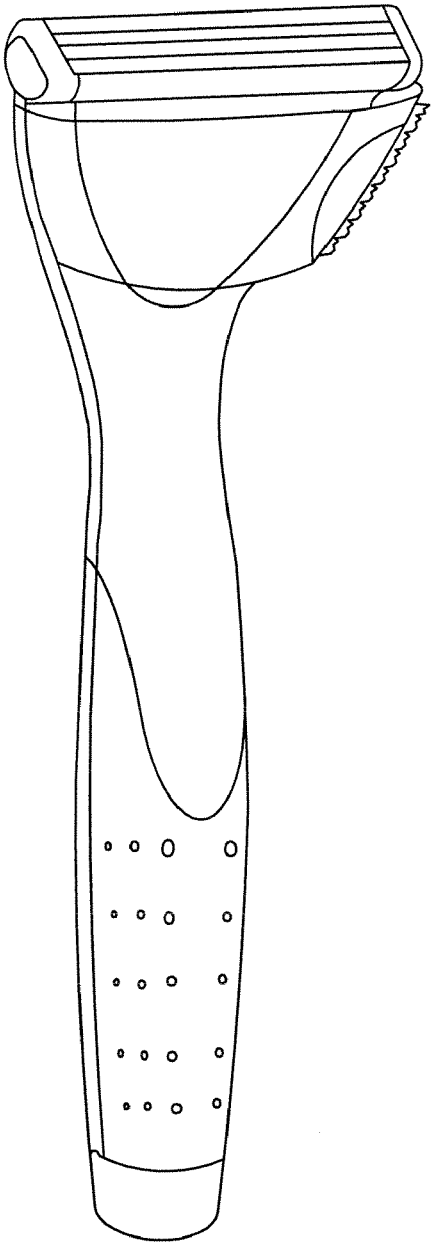
FIGS. 8A and 8B are front and rear perspective views of another embodiment of a razor and trimmer combination assembly.
Figure 8B:
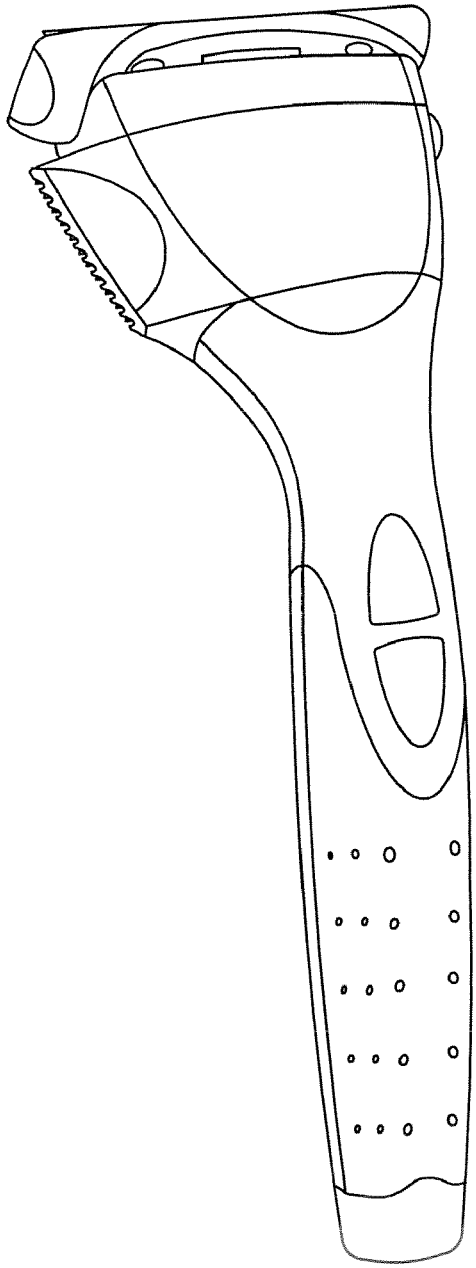
Figure 9A:
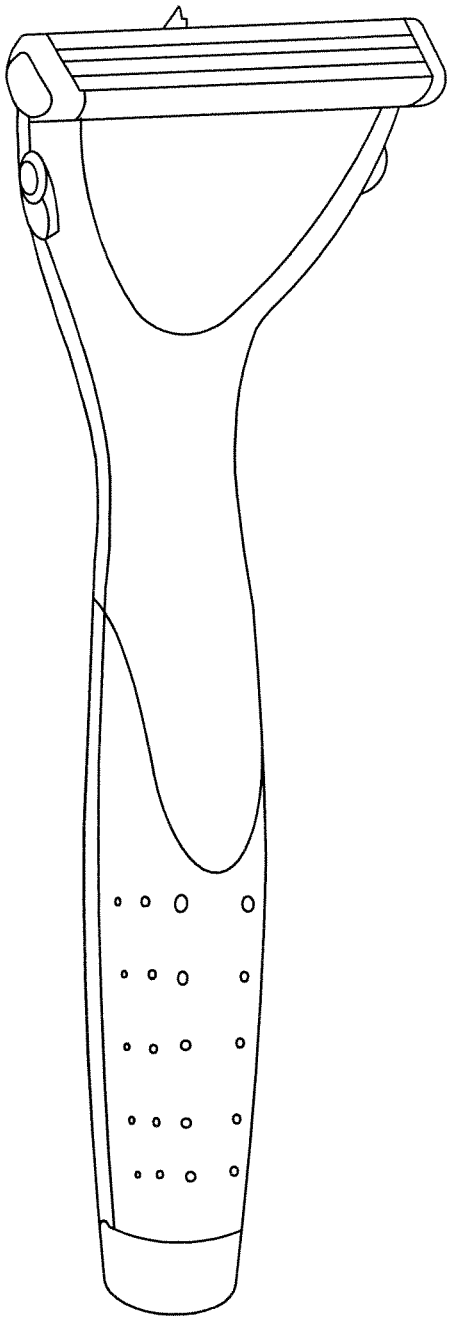
FIGS. 9A and 9B are front and rear perspective views of another embodiment of a razor and trimmer combination assembly.
Figure 9B:
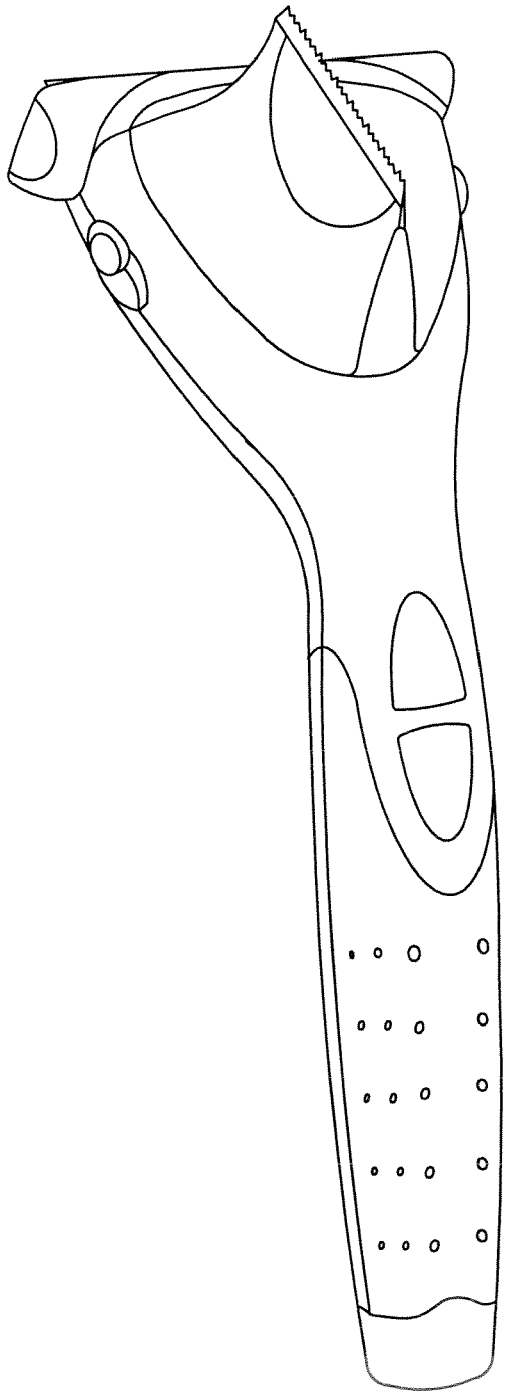
Figure 10C:
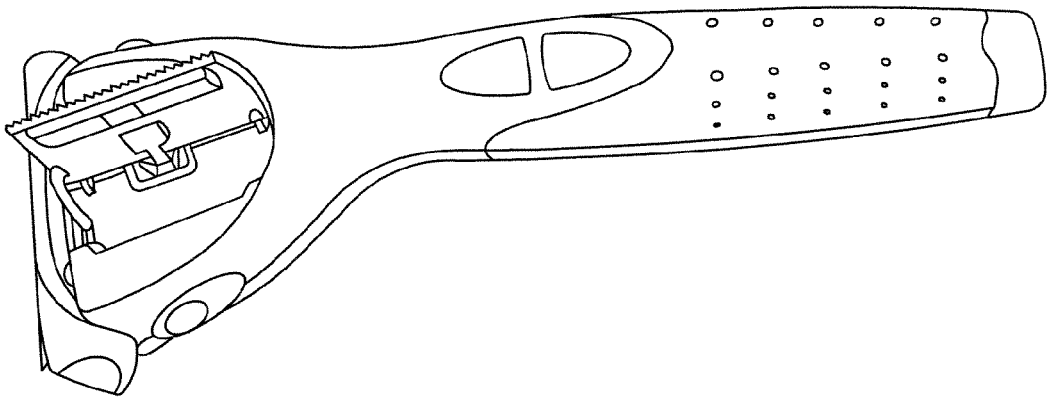
FIGS. 10A-10C are front and rear perspective views of another embodiment of a razor and trimmer combination assembly.
Figure 10B:
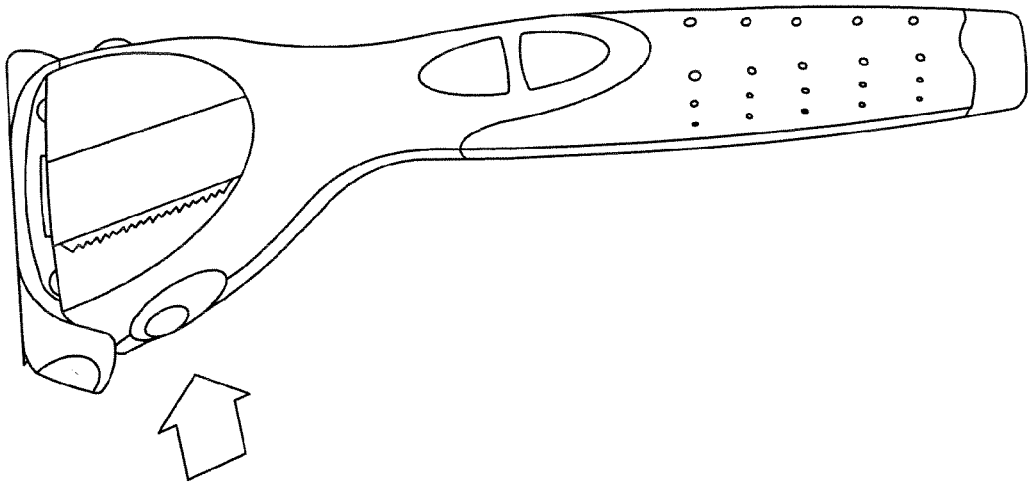
Figure 10A:
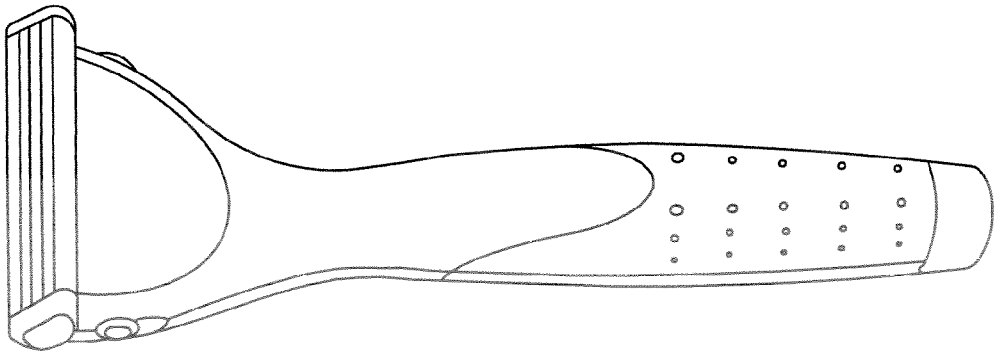
Figure 11C:
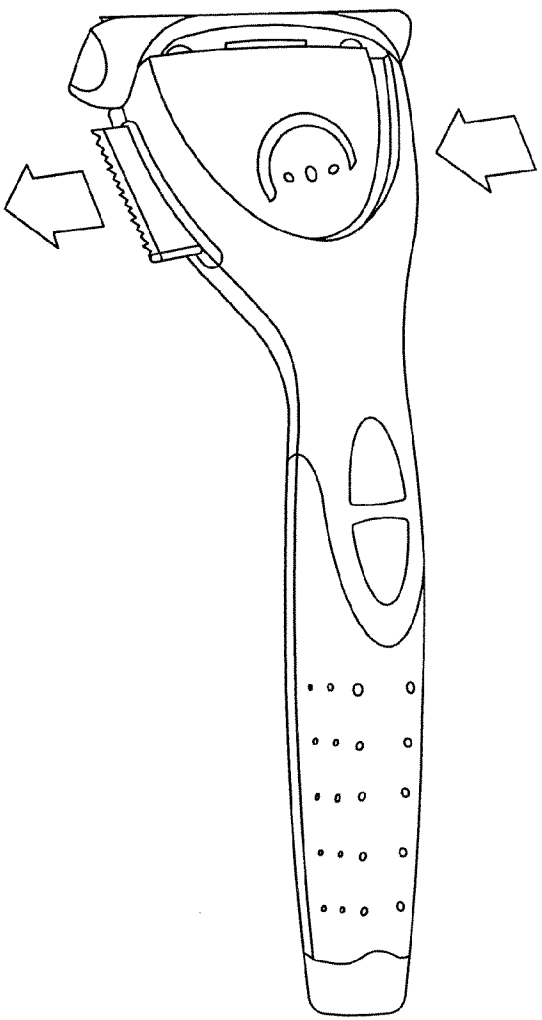
FIGS. 11A-11C are front and rear perspective views of another embodiment of a razor and trimmer combination assembly.
Figure 11B:
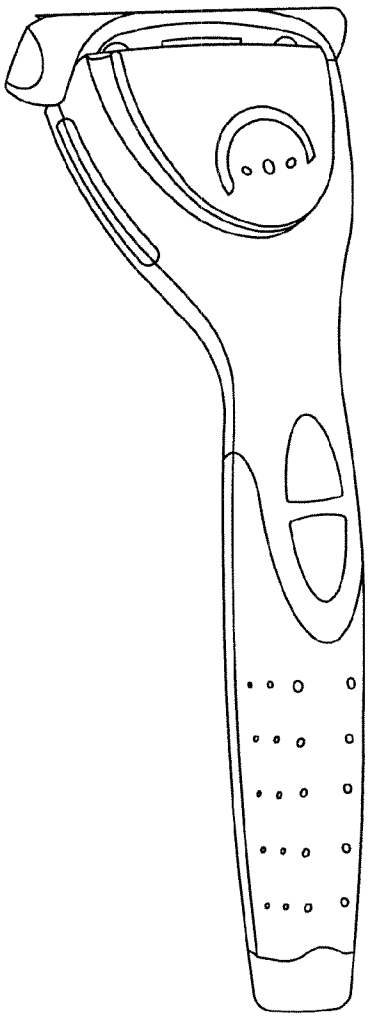
Figure 11A:
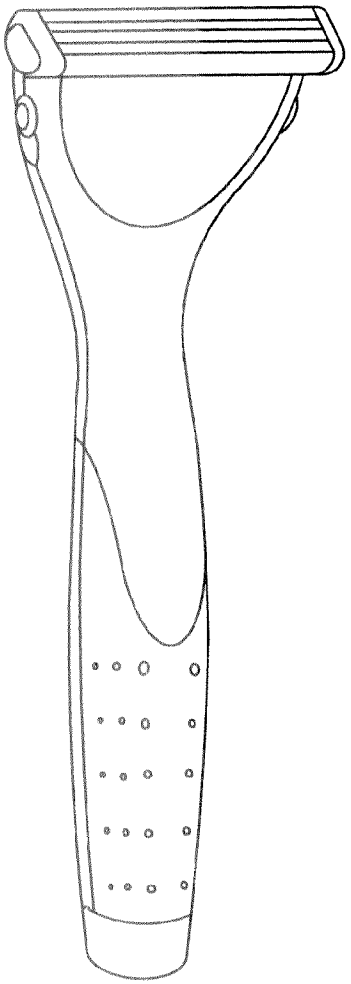

In addition to the external configurations disclosed in FIGS. 1A-1D, many different configurations of grooming tools are contemplated. A few non-limiting examples of designs are depicted in the accompanying figures. For example, in FIGS. 5A, 5B and 5C, a trimmer pivots between a use position where the trimmer extends from the handle and a stored position where the trimmer rests against the handle. In this configuration the razor blade and the trimmer face opposite sides of the handle. FIGS. 6A,6B and 6C show a grooming tool where a pivoting trimmer is disposed the under and on the same side of the handle as the razor blade cartridge. FIGS. 7A and 7B disclose a grooming tool where a trimmer is disposed on an opposite side of the handle as the razor blade cartridge. The embodiment in FIGS. 7A and 7B discloses a stationary trimmer, as opposed to a moveable trimmer. FIGS. 8A and 8B disclose a stationary trimmer disposed on a lateral side of the handle such that trimmer is aligned generally perpendicular to the length of the razor blade cartridge. FIGS. 9A and 9B disclose a trimmer disposed generally perpendicular to the length of the razor blade cartridge on an opposite side of the handle that the razor blade cartridge faces. FIGS. 10A, 10B and 10C disclose a pivoting trimmer disposed generally perpendicular to the length of razor blade cartridge on an opposite side of the handle that the razor blade cartridge faces. FIGS. 11A, 11B and 11C disclose the trimmer selectively disposed inside the handle and extending from a lateral side of the handle.

Figure 12:
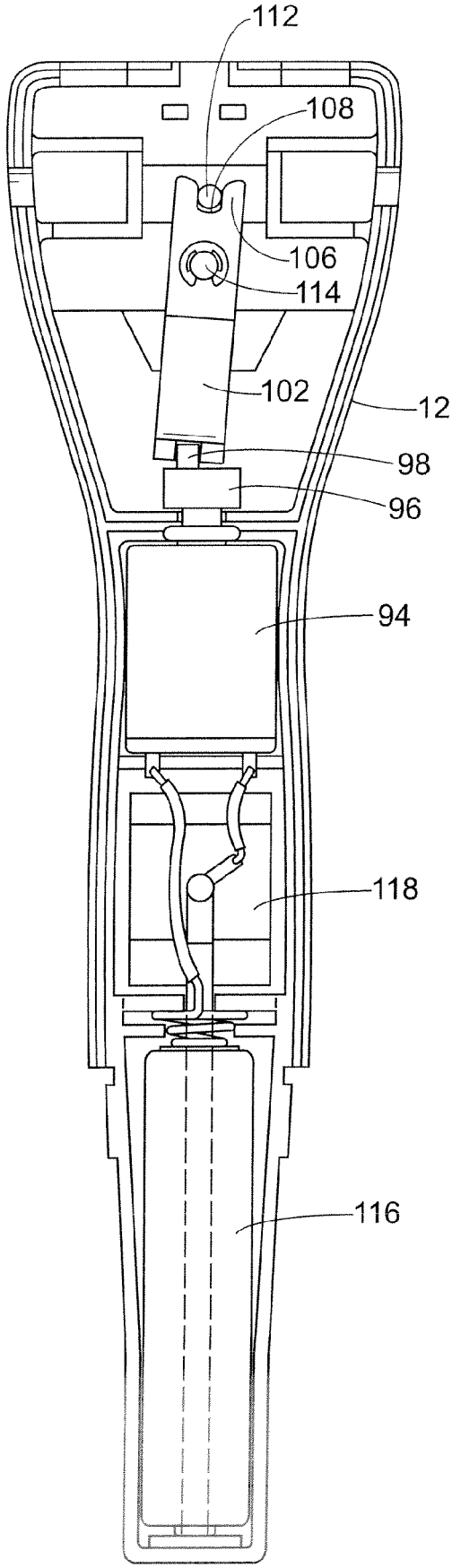
FIG. 12 is an alternative embodiment of a drive train assembly disposed in a handle of an embodiment of a razor and trimmer combination assembly.

An alternative configuration of a drive train for the moving blade of the trimmer is also disclosed. This configuration can be useful for a grooming tool where the trimmer pivots in relation to the handle; however, as mentioned above, any drive train that provides the lateral movement of the moving blade and can mount in or to the handle can be used to drive the moving blade. With reference to FIG. 12, a motor 94 drives a cam 96 that includes a small projection 98 that is offset from and generally parallel to the axis of the output shaft (not visible) of the motor 94. The projection 98 engages an arm 102 that engages the moving blade 42 of the trimmer 24.

Figure 13:
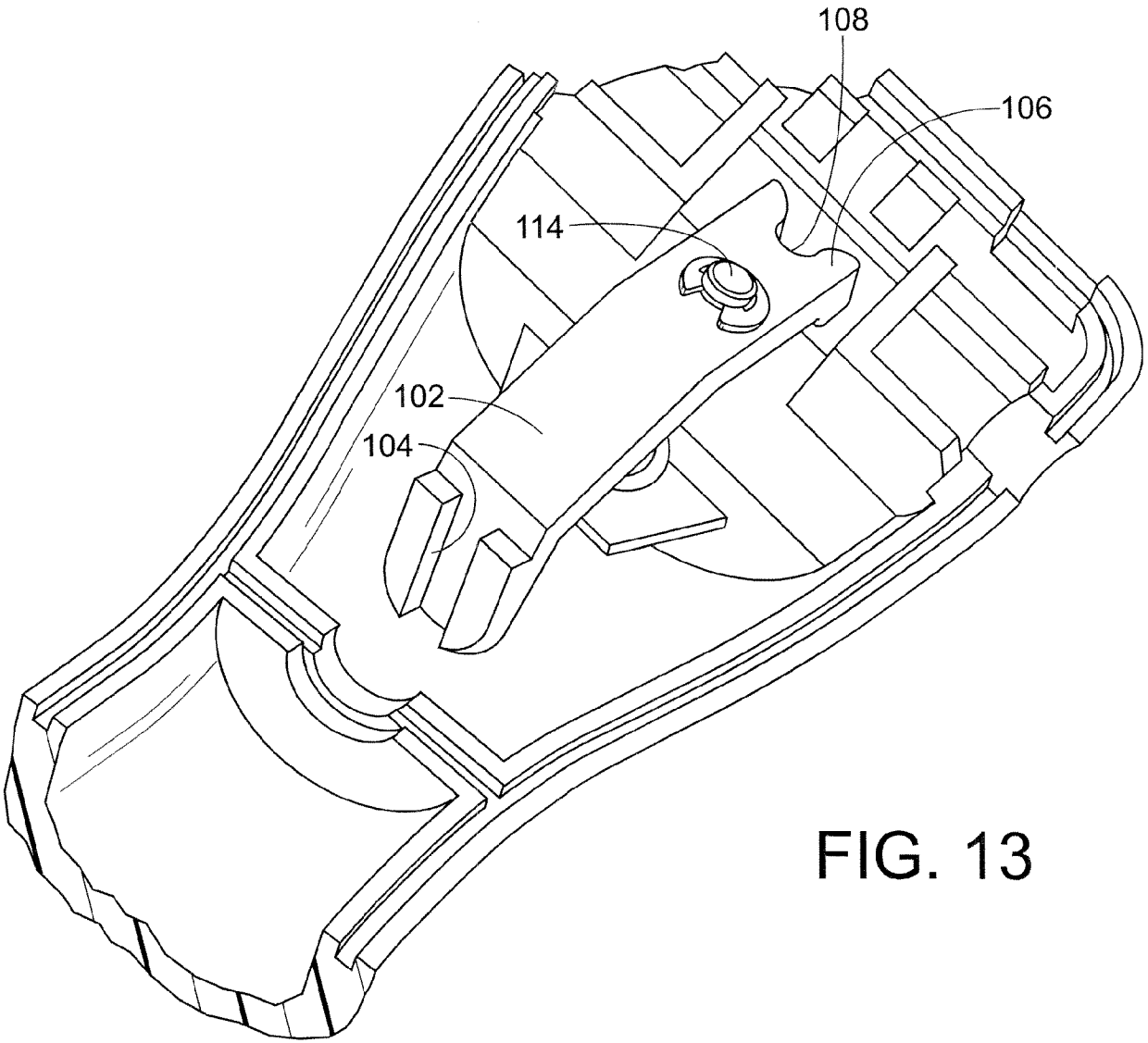
FIG. 13 is a close-up view of a portion of the drive train assembly of FIG. 12.
Figure 14:
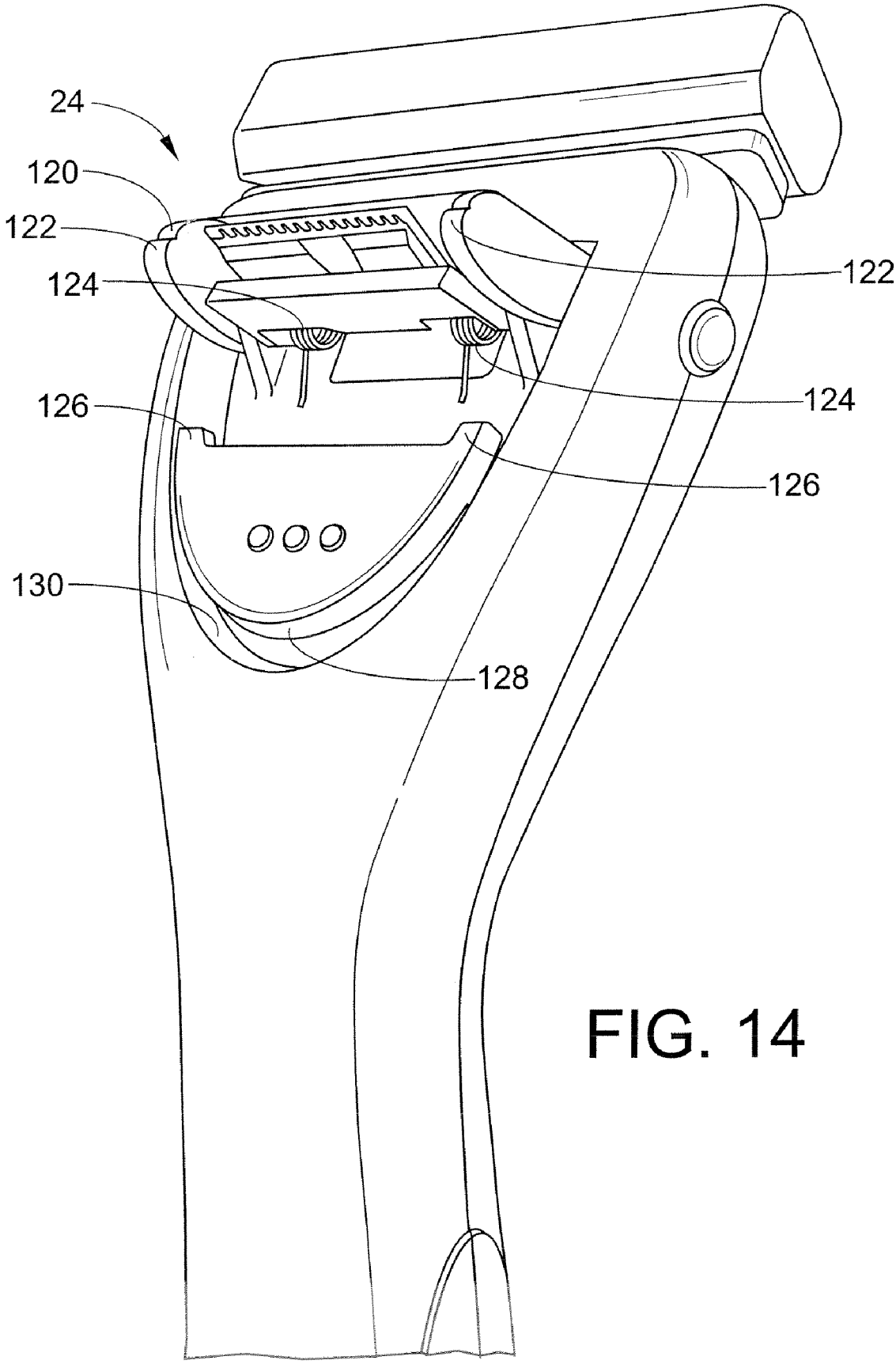
FIG. 14 is a close-up view of a trimmer of an embodiment of a razor and trimmer combination assembly.

With reference to FIG. 13, the arm 102 includes a vertical elongated slot 104 at one end that receives the projection 98. The arm 102 also includes a forked end 106 at the end of the arm opposite the vertical slot 104 that defines an inlet 108 that receives a post 112 (FIG. 12) that is attached to the moving blade 42 of the trimmer 24. The arm 102 attaches to the handle 12 via a pin 114 that the arm 102 pivots about.

In use, the motor 94 engages and rotates the cam 96 which results in the off-center projection 98 rotating about the axis of the output shaft. Since the slot 104 of the arm 102 is open in a vertical direction, vertical forces of the projection 98 are not transferred to the arm 102 so that the arm only moves in a side-to-side or horizontal direction. The side-to-side movement of the arm 102 results in a side-to-side movement of the forked end 106 that receives the post 112 in its inlet 108. Accordingly, the post 112 moves side-to-side moving the second or moving blade 42 side-to-side. As seen in FIG. 12, a battery 116 can supply power to the motor 94. Also a switch 118 can selectively open and close the circuit between the motor 94 and the battery 116.

An embodiment using the drive train depicted in FIGS. 12 and 13 can also provide desirable vibration of the handle in which the drive train is housed. Not only can the lateral reciprocal movement of the moving trimmer blade provide the desirable vibration, but also the off-center projection rotating about the output shaft of the motor and the movement of the pivoting arm can also result in desirable vibration of the handle.

As noticeable in FIGS. 5A, 5B, 5C, 6A, 6B, 6C, 10A, 10B, and 10C, in addition to sliding, the trimmer 24 connects to the handle 12 and pivots about a pin or pins (not shown) between the use position and the stored position. In these embodiments, the trimmer 24 includes a sheath 120 that protects the first blade 40 and the second blade 42. The sheath 120 includes a pair of fingers 122 at a distal end spaced on opposite sides of the blades 40, 42. The trimmer 24 is biased away from the handle 12 by a pair of springs 124. The fingers 122 engage projections 126 located on a release button 128. The release button 128 pivots and/or slides in a recess 130 that also receives the trimmer 24 when in the stored position such that the projections 126 selectively engage the fingers 122 of the sheath 120 when it is desired to have the trimmer 24 in the stored position. The release button 128 is biased such that the projections 126 are positioned to engage the fingers 122 of the sheath 120. Movement of the projections 126 away from the fingers 122 results in the springs 124 biasing the trimmer 24 away from the handle 12 into the use position.

Figure 15:
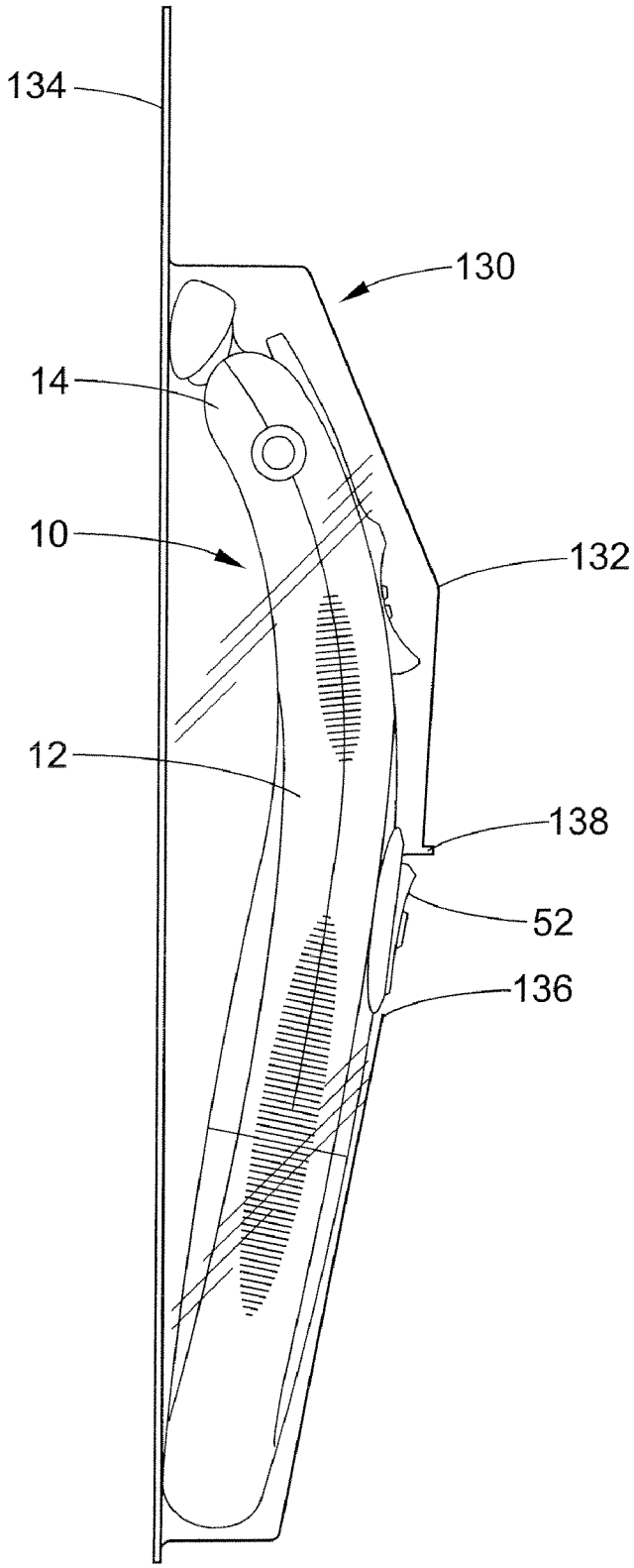
FIG. 15 is a side view of an embodiment of a razor and trimmer combination assembly disposed in a package.

Grooming tools such as those described above are typically sold in a package 130, as shown in FIG. 13. The package can be a blister-type package or another conventional-type package. As described above, the switch button 52 for the grooming tool 10 has a momentary on position where the switch button is depressed towards the handle 12 and a continuous on position where the switch button is slid upward toward the upper end 14 of the handle 12. The package 10 allows the customer to press the switch button 52 into the momentary on position while preventing the customer from urging the switch button into the continuous on position. The package 130 includes a cover 132 which can be a transparent blister. The cover attaches to a backing 134, which can be comprised of paperboard. In the embodiment depicted in FIG. 15, the package 130 includes an opening 136 formed in the cover 130 adjacent the switch button 52. The opening 136 allows the customer to press the switch button 52 into the momentary on position. The package 130 also includes a rib 138 to prevent the customer from sliding the switch button 52 into the continuous on position. Alternative structures to prevent movement of the button 52 into the continuous on position can also be provided. One example includes an edge of the opening 136 preventing sliding movement of the switch button 52, especially where close tolerance exists between the opening 136 and the switch button 52.

In an alternative embodiment, a package can be provided that allows a customer to urge the switch button into the momentary on position while preventing the urging of the switch button into the continuous on position without having an opening. For example, the cover can include a flexible portion adjacent the switch button 52 that allows for the button 52 to be depressed through the cover while precluding the consumer from sliding the switch button 52 into the continuous on position. In such an embodiment, a structure, such as but not limited to the rib described above, can prevent movement of the switch button into a continuous on position.

In alternative grooming tool embodiments, two switch buttons can be provided (see FIGS. 4A-4C). In these embodiments, the "on" switch button, which places the switch of the grooming tool into a continuous on position, can be enclosed by the cover so that the consumer cannot depress the "on" switch through the cover. The "off" switch button, which turns off the continuous on position and places the switch in a momentary on position while depressed, can be exposed via an opening or flexible area of the cover, as discussed above with reference to a grooming tool having one switch button. Accordingly, with the embodiments described above, a consumer can try the grooming tool while still in the package, but the consumer will be precluded from continuously turning on the grooming tool.

A number of different embodiments of a grooming tool that combines the benefits of an electric trimmer and a wet shaver have been disclosed. Obviously, modifications and alterations will occur to others upon a reading and understanding of the preceding detailed description. The invention, which is defined by the appended claims, is intended to cover all alterations and modifications insofar as they come within the scope of the appended claims and the equivalents thereof.

What is claimed:

1. A grooming tool, comprising:

an elongated handle having a first end and a front side, the front side facing a forward direction for the grooming tool;

a razor blade cartridge generally facing the forward direction for direct contact with skin and comprising one or more elongated razor blades mounted in the cartridge, the razor blade cartridge being mounted in a razor mount located adjacent to the first end of the elongated handle;

a trimmer located adjacent to the first end of the elongated handle, the trimmer comprising at least one elongated moving blade generally facing the forward direction, the at least one elongated moving blade having a length generally parallel with a length of the one or more elongated razor blades;

a motor located within the elongated handle, the motor having an output shaft operatively connected to the at least one moving blade for driving the at least one moving blade and for imparting vibratory motion on the handle and the razor blade cartridge;

a transmission assembly continuously coupling the output shaft of the motor to the at least one moving blade of the trimmer, and including a cam having an off-center projection and an arm, the cam being coupled to the output shaft, the off-center projection being coupled to the arm to provide reciprocating lateral movement of the at least one moving blade in a direction generally parallel to the length of the one or more elongated razor blades; and wherein the relative positions of the trimmer and the razor blade cartridge can be selectively adjusted through a sliding arrangement such that the grooming tool can be configured in at least a first operational position and a second operational position, and wherein (i) in the first operational position, the trimmer extends beyond the razor blade cartridge such that the trimmer is useable as the motor provides the reciprocating lateral movement of the at least one moving blade, and (ii) in the second operational position, the razor blade cartridge extends beyond the trimmer such that the one or more elongated razor blades are useable while the motor provides the vibratory motion to the handle and the razor blade cartridge.

2. The grooming tool of claim 1 wherein the rotational movement of the off-center projection provides the vibratory motion to the handle and the razor blade cartridge.

3. The grooming tool of claim 1, wherein the elongated handle is curved toward the front side of the elongated handle.

4. The grooming tool of claim 3, wherein the elongated handle includes a recess providing the sliding arrangement generally along a length of the elongated handle.

5. The grooming tool of claim 4, wherein a sliding member moves within the recess, the sliding member including a curved surface for receiving a thumb or finger of an operator of the grooming tool.

6. The grooming tool of claim 5, wherein the trimmer is coupled to the sliding member that slides within the recess.

7. The grooming tool of claim 1, wherein the razor blade cartridge is fixed relative to the first end of the handle, and the trimmer slides relative to the first end of the handle.

8. The grooming tool of claim 1, further including an off-axis weight rotated by the output shaft of the motor, the off-axis weight providing the vibratory motion to the handle and the razor blade cartridge.

9. The grooming tool of claim 8 wherein the off-axis weight is located directly on the output shaft of the motor.

10. The grooming tool of claim 1, wherein the handle is made from multiple handle components, and the grooming tool further includes gaskets to inhibit entry of water into an interior of the handle during exposure of the grooming tool to water.

* * * * *